US005821039A

United States Patent [19]

Leone et al.

[11] Patent Number: 5,821,039

[45] Date of Patent: Oct. 13, 1998

[54] PHOTOGRAPHIC ELEMENT CONTAINING NEUTRAL DYE-FORMING RESORCINOL COUPLER

[75] Inventors: Ronald E. Leone, Rochester; Stephen P. Singer, Spencerport, both of N.Y.

[73] Assignee: Eastman Kodak Company, Rochester, N.Y.

[21] Appl. No.: 866,786

[22] Filed: May 30, 1997

[51] Int. Cl.[6] ..... G03C 7/32

[52] U.S. Cl. ..... 430/376; 430/543

[58] Field of Search ..... 430/364, 376, 430/402, 543

[56] References Cited

U.S. PATENT DOCUMENTS

| | | | |
|---|---|---|---|
| 3,770,431 | 11/1973 | Gates et al. | 430/214 |
| 4,126,461 | 11/1978 | Pupo et al. | 430/402 |
| 4,429,035 | 1/1984 | Kato et al. | 430/402 |
| 4,469,785 | 9/1984 | Tanaka et al. | 430/572 |
| 4,472,496 | 9/1984 | Tanaka et al. | 430/542 |
| 5,561,035 | 10/1996 | Singer et al. | 430/551 |
| 5,561,036 | 10/1996 | Singer et al. | 430/551 |

FOREIGN PATENT DOCUMENTS

| | | |
|---|---|---|
| 0 071 570 | 2/1983 | European Pat. Off. . |
| 58-140739 | 2/1982 | Japan . |
| 61-129640 | 11/1984 | Japan . |

*Primary Examiner*—Hoa Van Le
*Attorney, Agent, or Firm*—Arthur E. Kluegel

[57] ABSTRACT

A color photographic element which comprises a light sensitive silver halide emulsion layer containing a 5-carbamoyl-1,3-dihydroxybenzene compound having a ClogP of at least 4. The element provides a black and white image using conventional color negative processing.

21 Claims, No Drawings

PHOTOGRAPHIC ELEMENT CONTAINING NEUTRAL DYE-FORMING RESORCINOL COUPLER

FIELD OF THE INVENTION

This invention relates to photographic elements containing 5-carbamoyl resorcinol (1,3-dihydroxybenzene) neutral dye forming couplers.

BACKGROUND OF THE INVENTION

It has become desirable to be able to form black and white images employing the conventional processes for the formation of color negative films and color negative prints. This enables processing without special handling and thereby avoids the added costs and time delay associated therewith. Moreover, the added expense of forming an image composed of silver is avoided.

When forming a black and white image using dye rather than silver, it is highly desirable to have a single coupler that is capable of forming a neutral (black) dye image after processing as opposed to having a combination of two or more couplers. This is to avoid problems of matching the reactivity towards oxidized developer in the coupler mixture in order to maintain a constant neutral hue both throughout the exposure scale and as processing conditions vary. EP 0 071 570 and U.S. Pat. No. 4,429,035 describe resorcinols (1,3-dihydroxybenzene compounds) as useful 'black' couplers; that is, they form a neutral dye image. In particular, the latter patent describes resorcinols substituted in the 5 position (among other variations with the 2 position being most preferred) with a carbonyl group attached to a group preventing diffusion in a photographic element. The anti-diffusion group attached to the carbonyl is described as being an alkyl or aromatic group. Materials of this type are insufficient in activity towards oxidized developer.

The use of 5-substituted ballasted resorcinol (1,3-dihydroxybenzene) compounds as scavengers for oxidized developer are generally described in U.S. Pat. No. 3,770,431. However, the disclosed scavengers (5-alkyl and 5-carbonamido substituted) are insufficient in activity. U.S. Pat. No. 3,772,014 describes polymeric resorcinols as useful scavengers, but the disclosed scavengers (5-carbonamido substituted) are insufficient in activity. Published Japanese Patent Application 61-129640 discloses some 2-substituted resorcinols in combination with selected sensitizing dyes. Published Japanese Patent Application 58-140739 discloses 2-substituted resorcinols in photographic systems.

U.S. Pat. No. 4,126,461 discloses a photographic element containing a nondiffusible resorcinol coupler together with an incorporated developing agent to obtain an image of desirable density. The element is processed so as to provide both a silver image and a dye image. The only resorcinol having a 5-carbamoyl group (RC-62) was not synthesized by the patentee, and its hydrophobicity and processing methodology are insufficient to meet the requirements of the invention. Exemplified resorcinols having a 2-carbamoyl substituent (RC-61) are shown to produce a blue-black image in Table IV. Another of the samples, one containing a 2-sulfonamido substituent (RC-65), is shown to produce a purple-black image in Table III.

A problem to be solved is to provide a photographic element containing a coupler capable of producing a neutral black image of sufficient density using conventional color processing in which the black density is of improved uniformity for blue, green and red exposures.

SUMMARY OF THE INVENTION

The invention provides a color photographic element which comprises a light sensitive silver halide emulsion layer containing a 5-carbamoyl-1,3-dihydroxybenzene compound having a ClogP of at least 4. The invention also provides a process for forming an image in such an element.

Such an element provides a photographic element containing a coupler capable of producing a neutral black image of sufficient density using conventional color processing in which the black density is of improved uniformity for blue, green and red exposures.

DETAILED DESCRIPTION OF THE INVENTION

The compounds of the invention are useful when included directly in an imaging layer for the purpose of creating a neutral colored (black) dye image. Such neutral images are useful either on transparent support (as in color negative or color reversal type products) or on opaque reflective supports (as in color negative paper products).

The log P referred to herein is the logarithm of the partition coefficient between octanol and water. The photographic element of the invention is a multiphase material and therefore the coupler can distribute itself among the different phases present. The log P indicates the relative solubility of the coupler in the hydrophobic and hydrophilic phases of the element. A compound which partitions equally between the two phases will have a log P of 0. Higher log P values indicate that the compound exhibits increasingly greater hydrophobic properties. Materials with high log P values are essentially confined to the organic phase surrounding the coupler and are not likely to migrate to the hydrophilic gel phase where the light sensitive silver is. This may be particularly important where it is desired to prevent a compound such as a thio coupling-off group from attacking the silver and inhibiting it from developing.

Rather than performing a partition experiment, it is a preferred alternative to calculate the log P of a substituent. The log P values are calculated using the Medchem program, version 3.54, Medicinal Chemistry Project, Pomona College, Claremont Calif. (1984).(For a discussion of this method see Albert J. Leo, in "Comprehensive Medicinal Chemistry", edited by C. Hansch, P. G. Sammes, and J. B. Taylor, Pergamon Press, New York, Volume 4, 1990 and U.S. Pat. No. 4,782,012.) These calculated values are referred to as CLogP. Values for estimating the log P (or pi) of a substituent are shown in the article of C. Hansch and A. J. Leo, in "Substituent Constants for Correlation Analysis in Chemistry and Biology", Wiley, New York, N.Y. (1979).

It is not desirable for the resorcinol to have any group with an additional O—H or an N—H group attached directly to the aromatic nucleus in any position. Such compounds can undergo oxidation-reduction type reactions leading to poor stability before processing and generation of stains in the Dmin after processing. The resorcinols of the invention undergo a coupling reaction directly with oxidized developer and are not electrochemically active.

One embodiment of the invention is represented by formula I:

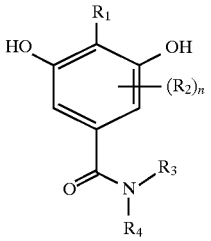

(I)

The 2-position substituent, $R_1$, is hydrogen or a coupling-off group other than one that contains a —NH-group attached directly to the dihydroxybenzene nucleus. Suitably $R_1$ is H , chloro, or bromo and is conveniently H.

Each resorcinol ring substituent in the 4-, or 6-position, $R_2$, is an independently selected substituent other than hydroxy and other than a group that contains an —NH-group attached directly to the dihydroxybenzene nucleus. It is generally suitable to have H at these positions but other suitable candidates are chloro, bromo, and thio groups. "n" is 0, 1 or 2 with 0 normally satisfactory.

The N-substituents, $R_3$, and $R_4$, are independently selected from hydrogen, an alkyl group and an aryl group. It is desirable that they are not both H with one being H and the other being alkyl or aryl.

Any two of $R_2$, $R_3$ and $R_4$ can be linked together to form one or more ring systems.

The CLogP of the compound must be at least 4, preferably at least 5 and typically will be at least 7.

In a particular embodiment, $R_3$ is hydrogen, an alkyl group or an aryl group; and $R_4$ is an alkyl group or an aryl group;

with the proviso that the sum of carbon atoms in $R_3$ and $R_4$ is 8 or more so that the compound is ballasted in the photographic film. In a further embodiment, the compound is as above and $R_3$ is hydrogen.

The photographic element of the invention is desirably free of incorporated developer, which can create raw stock keeping problems. The element is one which can be processed using one of the conventional processes such as the Kodak C-41, Kodak RA-4 or Kodak E-6 processes described in the British Journal of Photography Annual of 1988, pp 191 et seq. These processes are characterized in their use of p-phenylene diamine developers and in the removal of the silver during processing.

The following are examples of 5-carbamoyl resorcinol compounds useful in the invention:

| SAMPLE | COUPLER | CLogP |
|---|---|---|
| S-1 | 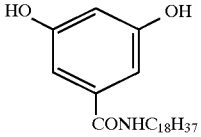  | 9.0 |

-continued

| SAMPLE | COUPLER | CLogP |
|---|---|---|
| S-2 | 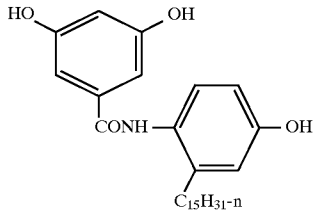  | 8.3 |
| S-3 | 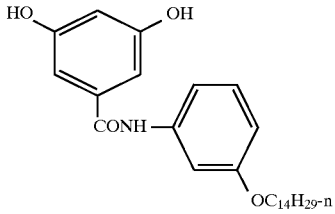  | 8.8 |
| S-4 | 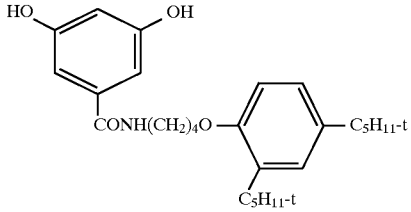  | 7.2 |
| S-5 | 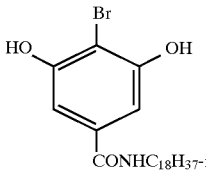  | 9.6 |
| S-6 | 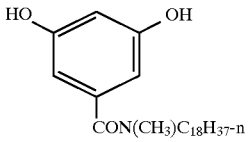  | 9.1 |
| S-7 | 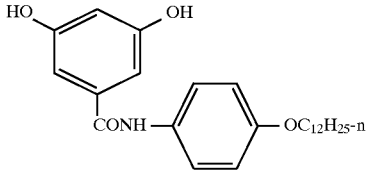  | 7.7 |
| S-8 | 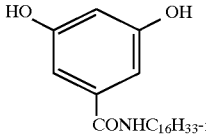  | 8.0 |
| S-9 | 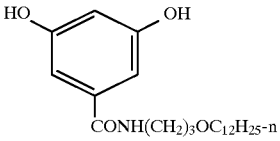  | 5.5 |

-continued

| SAMPLE | COUPLER | CLogP |
|---|---|---|
| S-10 | 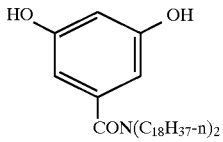 | 18.1 |
| S-11 | 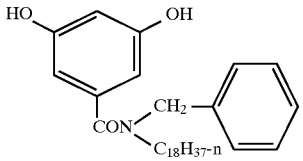 | 10.8 |
| S-12 | 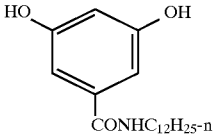 | 5.9 |
| S-13 | 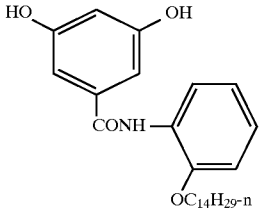 | 8.2 |
| S-14 | 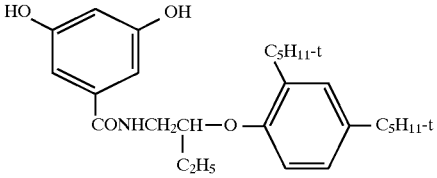 | 7.6 |
| S-15 | 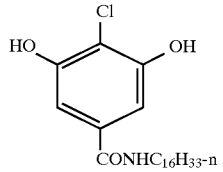 | 8.4 |

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsufinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a layer on a support to form part of a photographic element.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

A typical photographic element comprises a support bearing one or more silver halide emulsion layers of varying degrees of light sensitivity. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

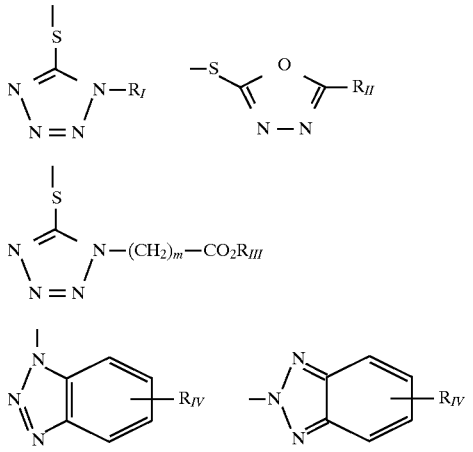

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

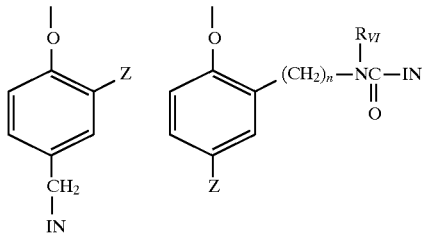

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

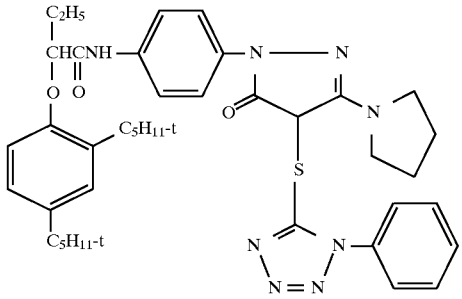

D2

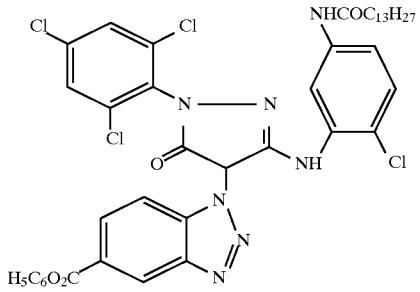

D3

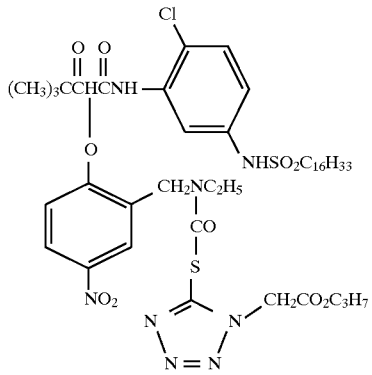

D4

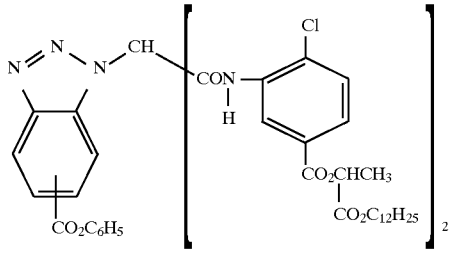

-continued
D5
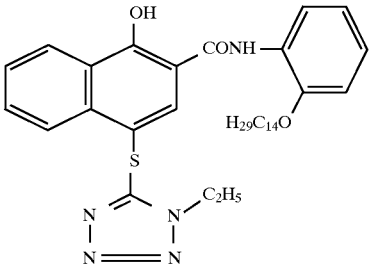
D6
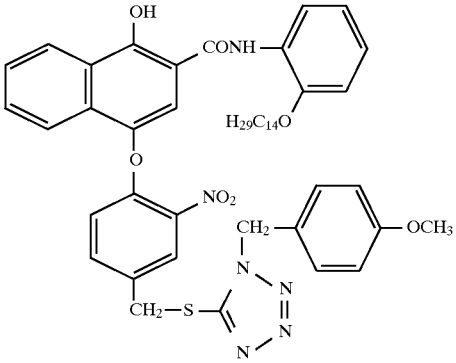
D7
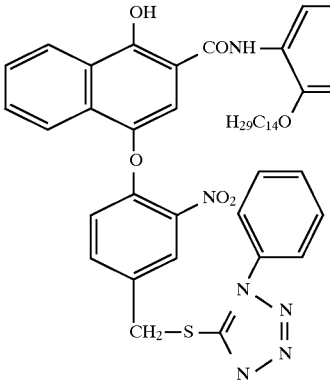
D8
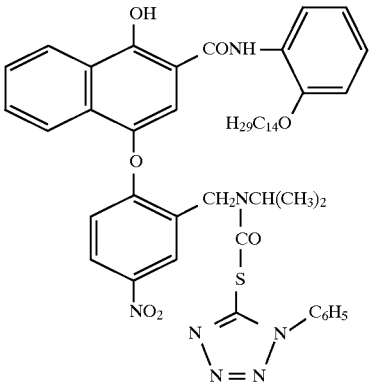
-continued
D9
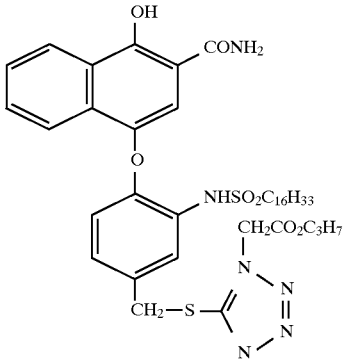
D-10
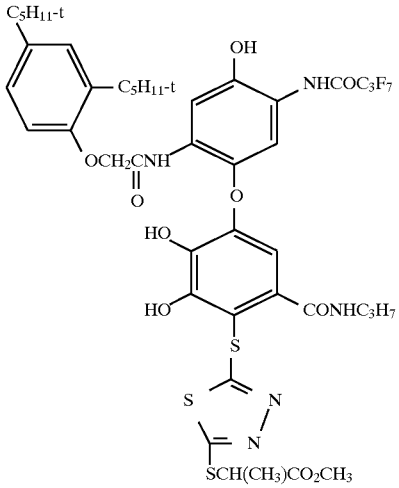
D11
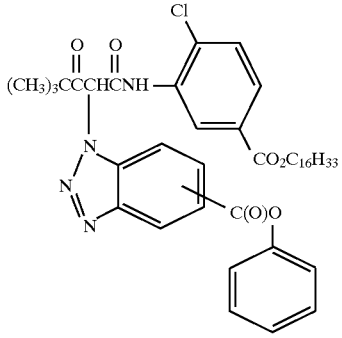
D12
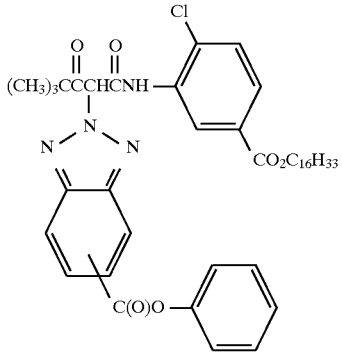

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072, 634; 90-077,822; 90-078,229; 90-078,230; 90-079,336; 90-079,337; 90-079,338; 90-079,690; 90-079,691; 90-080, 487; 90-080,488; 90-080,489; 90-080,490; 90-080,491; 90-080,492; 90-080,494; 90-085,928; 90-086,669; 90-086, 670; 90-087,360; 90-087,361; 90-087,362; 90-087,363; 90-087,364; 90-088,097; 90-093,662; 90-093,663; 90-093, 664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.07$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements may then be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

Elements destined for color reflection prints are provided on a reflective support, typically paper, and may be optically printed using the so-called negative-positive process where the element is exposed to light through a color negative film which has been processed as described above. The print may then be processed to form a positive reflection image using, for example, the Kodak RA-4 process as described in The British Journal of Photography Annual of 1988, Pp 198–199. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41), color print (Kodak RA-4), or reversal (Kodak E-6) process. Such processes employ one of several para-phenylene diamine developing chemicals and are collectively referred to herein as conventional color negative processes in order to distinguish them from exotic or nonstandard processes that rely on a developer incorporated in the film to achieve the desired density, for example.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patent applications, patents and other publications referred to in this specification are incorporated herein by reference.

Synthesis

The resorcinol compounds of this invention can be prepared by reactions and methods that are well known in the organic chemistry synthesis art. A general scheme is outlined below. The specific synthesis of inventive compound S-1 is also given.

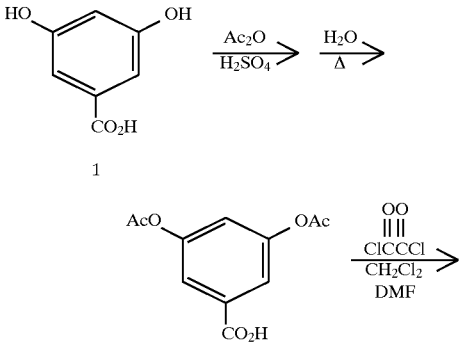

-continued

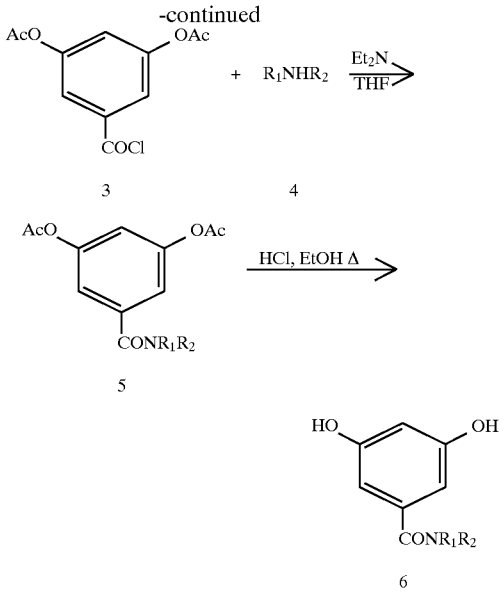

3,5-Diacetoxybenzoic acid (2):

3,5-Dihydroxybenzoic acid 1 (30.8 g, 0.20 mol) was mixed with acetic anhydride (142.8 g, 1.40 mol). The resulting suspension was stirred and warmed slightly. Concentrated sulfuric acid (6 drops) was added; a yellow solution formed. The solution was heated for 5 minutes at 75°–80°. The warm solution was poured with stirring into water (600 mL). The aqueous mixture was stirred vigorously and was heated to 50°–55° for 20 minutes. After approximately 5 minutes a clear solution formed. Subsequently a white solid began separating out of solution. The mixture was cooled to room temperature, then was chilled in ice. The cold mixture was filtered and the collected solid was washed with water. The product was dried in a vacuum oven at 50° under nitrogen over a week-end. This gave 3,5-diacetoxybenzoic acid as a cream colored powder, m.p. 149°–153°. Yield 40.6 g (85%).

3,5-Diacetoxybenzoyl Chloride (3):

3,5-Diacetoxybenzoic acid 2 (38.1 g, 0.16 mol) and oxalyl chloride (25.4 g, 0.20 mol) were mixed with dichloromethane (300 mL). The mixture was stirred at room temperature to form a slurry. N,N-Dimethylformamide (5 drops) was added and gas evolution occurred. The solid dissolved as the reaction proceeded. After 3½ hours gas evolution ceased. The solvent and excess oxalyl chloride were removed on a rotary evaporator. This gave a solid residue which was redissolved in fresh dichloromethane (300 mL). The solvent was again removed on a rotary evaporator. This gave the acid chloride as a white solid. Yield 41.1 g (100%). The material was used immediately without further purification.

3,5-Diacetoxy-N-n-octadecylbenzamide (5a, $R_1$=H, $R_2$=$C_{18}H_{37}$-n):

3,5-Diacetoxybenzoyl chloride 3 (41.1 g, 0.16 mol) was dissolved in dry tetrahydrofuran (500 mL). This solution was stirred at room temperature under a nitrogen atmosphere.

n-Octadecylamine 4a (40.4 g, 0.15 mol) was added in portions over 15 minutes. The mixture was stirred for 30 minutes at room temperature. Then a solution of triethylamine (15.2 g, 0.15 mol) in dry tetrahydrofuran (100 mL) was added dropwise over 1 hour. The reaction mixture was stirred at room temperature for 15 hours. The mixture was poured with stirring into a mixture of ice and water (1500 mL) and concentrated hydrochloric acid (150 mL). The product separated out as a solid. The aqueous mixture was filtered and the collected solid was washed with water. The product was sucked as dry as possible on the funnel. It was then recrystallized from a mixture of acetonitrile (1100 mL) and ethyl acetate (100 ml). The resulting cold mixture was filtered and the product was washed with cold acetonitrile. The product was dried in a vacuum oven at 50° overnight. This gave the benzamide as a white powder, m.p. 99°–101°. Yield 62.9 g (86%). An nmr spectrum and elemental analysis were correct for 3,5-diacetoxy-N-n-octadecylbenzamide.

3,5-Dihydroxy-N-n-octadecylbenzamide (6a, $R_1$=H, $R_2$=$C_{18}H_{37}$-n, S-1):

3,5-Diacetoxy-N-n-octadecybenzamide 5a (61.4 g, 0.125 mol) and concentrated hydrochloric acid (5.0 g) were mixed with ethanol (700 mL). The mixture was stirred and heated to reflux for 2 and ½ hours. The resulting reaction solution was allowed to cool to room temperature, then was poured with stirring into ice and water (2000 mL). The product came out of solution as a flocculent white solid. The aqueous mixture was filtered through a large Buchner funnel (18.5 cm); the filtration took approximately 2 hours. The collected solid was washed with water. The material was sucked as dry as possible on the funnel, then was dried in a vacuum oven at 50° over a week-end. The crude product was recrystallized from a mixture of acetonitrile (550 mL) and ethyl acetate (100 mL). The mixture was chilled in ice and then was filtered. The product was washed with cold acetonitrile. The material was dried in a vacuum oven at 50° for several hours. This gave S-1 as a white powder, m.p. 114°–117°. Yield 49.1 g (97%). An nmr spectrum was consistent with the structure of S-1. Anal. Calcd. for $C_{25}H_{34}NO_3$+0.25$H_2O$: C, 73.15; H, 10.61; N, 3.41. Found: C, 72.84; H, 10.29; N, 3.79. H.p.l.c. was 96.7%.

PHOTOGRAPHIC EXAMPLES

Examples 1 and 2

Control sample 1 and inventive samples 1 and 2 (color negative film format) were prepared by coating a cellulose acetate-butyrate film support with Rem-Jet antihalation backing first with a layer of 4.89 g/m$^2$ of gelatin, followed by a light sensitive layer containing 1.08 g/m$^2$ of green sensitized silver iodobromide emulsion, 3.77 g/m$^2$ of gelatin and 0.27 g/m$^2$ of coupler, followed by an overcoat with 2.69 g/m$^2$ of gelatin with bis-vinylsulfonyl methyl ether hardener at 1.75 weight % based on total gel. These samples were exposed imagewise through a stepped density test object and subjected to the Kodak Flexicolor (C-41) Process as described in *British Journal of Photography Annual,* 1988, pp. 196–198 using fresh unseasoned processing solutions. The blue, green and red densities at maximum exposure were tabulated in Table I.

| | | CLogP |
|---|---|---|
| CS-1 | 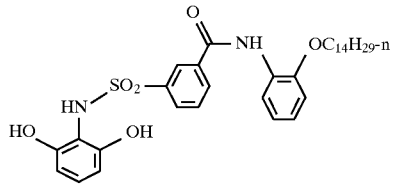 | 8.5 |

Example 3

Sample 3 (color paper format) was generated by coating 1.08 g/m$^2$ of S-1 (dispersed in twice its own weight of N,N,-dibutyllauramide) with 0.56 g/m$^2$ of blue sensitized silver chloride emulsion in 1.08 g/m$^2$ gelatin over a gel pad of 3.23 g/m$^2$ on gel-subbed, polyethylene-coated, $TiO_2$ impregnated opaque paper. This imaging layer was overcoated with a UV layer consisting of 1.33 g/m$^2$ gelatin, 0.73 g/m$^2$ of 2-(2H-benzotriazol-2-yl)-4,6-bis(1,1-dimethylpropyl)phenol and 0.13 g/m$^2$ of Tinuvin 326 (trademark of Ciba-Geigy) and finally, an overcoat of gelatin at 1.4 g/m$^2$ and bis(vinylsulfonyl)methane hardener at 0.14 g/m$^2$. This sample was given a stepped exposure and processed according to the Kodak Ektacolor RA-4 process as described in *The British Journal of Photography Annual* of 1988, pp 198–199. The results were as shown in Table I.

TABLE I

| Sample | Type | Coupler | Blue | Green | Red |
|---|---|---|---|---|---|
| Control 1 | Comp | CS-1 | Trace | — | — |
| 1 | Inv | S-1 | .461 | .493 | .343 |
| 2 | Inv | S-5 | .344 | .406 | .270 |
| 3 | Inv | S-1 | .800 | .870 | .800 |

The data of the table demonstrate that the coupler compounds of the invention are excellent neutral couplers, giving sufficient density in a balanced formation when located in an imaging layer. Control 1, which contains a 2-sulfonamido substituent similar to RC-65 of U.S. Pat. No. 4,126,461, fails to provide measurable density using conventional processing.

What is claimed is:

1. A color photographic element which comprises a light sensitive silver halide emulsion layer containing a 5-carbamoyl-1,3-dihydroxybenzene compound having a ClogP of at least 4.

2. The element of claim 1 wherein the compound contains substituents comprising at least 8 carbon atoms excluding the substituent at the 2-position.

3. The element of claim 1 wherein the 5-carbamoyl substituent is selected from alkyl and aryl carbamoyl groups.

4. The element of claim 1 wherein the 5-carbamoyl substituent is an N,N-disubstituted group.

5. The element of claim 3 wherein the 5-carbamoyl substituent is an alkylcarbamoyl group.

6. The element of claim 3 wherein the 5-carbamoyl substituent is an arylcarbamoyl group.

7. The element of claim 1 wherein the dihydroxybenzene compound is dispersed in an organic solvent.

8. The element of claim 7 wherein the dihydroxybenzene compound is dispersed in a carbonamido organic solvent comprising N,N-dibutyllauramide.

9. The element of claim 1 wherein the sum of the CLogP value for the dihydroxybenzene compound is at least 5.

10. The element of claim 1 wherein the element is substantially free of incorporated developer or a developer precursor.

11. The element of claim 1 wherein the element is a color negative element provided on a transparent support.

12. The element of claim 1 wherein the element is a color negative element provided on a reflective support.

13. The element of claim 1 wherein $R_3$ is hydrogen.

14. The element of claim 1 wherein $R_1$ is hydrogen.

15. A color photographic element which comprises a light sensitive silver halide emulsion layer containing a compound having a dihydroxybenzene nucleus represented by formula I:

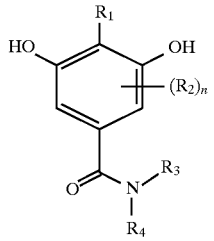

I wherein:

$R_1$ is hydrogen or a coupling-off group other than one containing an —NH group attached directly to the dihydroxybenzene nucleus;

each $R_2$ is an independently selected substituent other than hydroxy or a substituent that contains an —NH group attached directly to the dihydroxybenzene nucleus;

n=0, 1 or 2;

$R_3$, and $R_4$ are independently selected from hydrogen, an alkyl group and an aryl group;

provided that any two of $R_2$, $R_3$ and $R_4$ can be connected together to form one or more ring systems; and provided that the ClogP of compound (I) is at least 4.

16. The element of claim 15 wherein n is 0.

17. The element of claim 15 wherein the number of carbon atoms contained in $R_3$ and R4 taken together is at least 8.

18. The element of claim 15 wherein the 5-carbamoyl substituent is an alkylcarbamoyl group.

19. The element of claim 15 wherein the 5-carbamoyl substituent is an arylcarbamoyl group.

20. The element of claim 15 wherein the CLogP of the compound of formula (I) is at least 5.

21. A process for forming an image after an element as described in claim 1 is imagewise exposed, comprising contacting the element with a p-phenylene diamine color developer and thereafter removing the silver from the element.

* * * * *